US006761104B2

(12) United States Patent
Hoogen

(10) Patent No.: US 6,761,104 B2
(45) Date of Patent: Jul. 13, 2004

(54) LINEAR PATH SLIDE

(75) Inventor: Norbert Hoogen, Kleve (DE)

(73) Assignee: Heidel GmbH & Co. KG Werkzeug- u. Maschinenfabrikation, Viersen (DE)

( * ) Notice: Subject to any disclaimer, the term of this patent is extended or adjusted under 35 U.S.C. 154(b) by 276 days.

(21) Appl. No.: 10/006,262

(22) Filed: Dec. 5, 2001

(65) Prior Publication Data

US 2002/0038601 A1 Apr. 4, 2002

Related U.S. Application Data

(63) Continuation of application No. 09/564,078, filed on May 3, 2000.

(30) Foreign Application Priority Data

May 7, 1999 (DE) ..... 299 08 563
Mar. 30, 2000 (DE) ..... 200 05 776

(51) Int. Cl.[7] ..... F15B 15/14

(52) U.S. Cl. ..... 92/51; 92/52; 92/117 R; 91/196

(58) Field of Search ..... 91/216 R, 216 A, 91/216 B, 196; 92/117 R, 117 A, 51, 52

(56) References Cited

U.S. PATENT DOCUMENTS 5,609,091 A 3/1997 Stoll
5,615,598 A 4/1997 Noroy et al.
5,865,089 A * 2/1999 Langer et al. ..... 92/110
5,957,029 A * 9/1999 Boyer et al. ..... 92/117 A

FOREIGN PATENT DOCUMENTS

| | | |
|---|---|---|
| CH | 604021 | 8/1978 |
| DE | 3241233 | 5/1984 |
| DE | 3527155 | 2/1987 |

OTHER PUBLICATIONS

Raymond M K: "Compact Pneumatic Actuator Handles Heavy Loads", Machine Design, Cleveland, US, BD. 70, No. 3, Feb. 19, 1998.

* cited by examiner

*Primary Examiner*—Edward K. Look
*Assistant Examiner*—Igor Kershteyn
(74) *Attorney, Agent, or Firm*—Friedrich Kueffner

(57) ABSTRACT

The linear path slide (100) with a slide (10) which is arranged with a sliding guide (12) slidingly movable and resistant to torsion in a housing (11) and with a hydraulic driving gear which causes the translation movement of the slide (10) and which has a piston (24) arranged slidingly movable in a cylinder by constituting a hydraulic working space (13), is configured in such a way that the cylinder and the working space (13) are placed in the slide (10), the piston (24) being fixed with respect to the housing (11).

6 Claims, 5 Drawing Sheets

LINEAR PATH SLIDE

This is a continuation of application Ser. No, 09/564,078, filed May 3, 2000.

The present invention relates to a linear path slide with a slide which is arranged with a sliding guide slidingly movable in a housing and with a hydraulic driving gear which causes the movement of the slide and which has a piston arranged slidingly movable in a cylinder by constituting a hydraulic working space.

BACKGROUND OF THE INVENTION

Linear path slides of the above mentioned type are used as actuators in different devices for the processing and machining of metallic materials and plastic or plastic composite materials. The functions of these structural components typically include the pressing, forming, stamping, bending, beading, punching, jointing, jointing pressing as well as the carrying out of feeding functions with special requirements. Particular requirements are made to the properties of linear path slides among which especially a high energy density, a very high guiding exactitude as well as a very high stiffness against transverse loads and torsion are to be found. Furthermore, they should be constructed as compact as possible and allow, as standardized basic structural components, a flexible universal range of application. Moreover, properties such as maintenance-freedom during the whole lifetime, a robust construction for the use in polluted environment, the possibility of any fitting position, absolute tightness (for example by overhead mounting) and not least a low-cost production are desirable.

Different configurations of linear path slides are known. Because of the required high energy density, they are preferably hydraulic devices. However, basically the design as a pneumatically driven device is also possible.

Especially combinations of customary linear cylinders are known as compact built-in modules which are formed with stiff linear guiding units by "saddle-mounting" or by constituting a constructional longitudinal combination.

From DE-GM 71 04 168, we know a hydraulically or pneumatically acting slide for translating or swivelling blades, flaps or containers for which the hydraulic working spaces are configured in the stemple of the device. In order to protect the piston rod of the device used in severe conditions against dirt, faling rocks and the like, it is surrounded by a protecting sheath. The slide is guided only by the piston rod and thus does not show any torsion stiffness. Therefore, it is appropriate only for receiving linear forces.

Moreover, hydraulic block cylinders are known, the housings of which have additional bore holes for guiding rods which are placed parallel to the actual hydraulic cylinder. The piston rod head and one to usually four guiding rods at the most are screwed to each other in a top plate resistant to bending. This arrangement guarantees flexural strength and torsional strength.

Furthermore, from DE 295 17 615 U1, we know a linear path slide with a slide, which is placed slidingly movable in a housing with guide rollers and resistant to torsion, and with a hydraulic driving gear which causes the displacing of the slide and which shows a piston placed slidingly movable in a cylinder by constituting a hydraulic working space. Due to the only point support of the slide valve on the rollers, the torsional strength and the capacity of absorbing transverse loads are however limited.

Moreover, the linear path slide shows a relatively big axial overall length.

Another configuration of a linear path slide (Manufacturer Heidel GmbH und Co, KG, Viersen, Germany) is known for the particularly high requirements in the field of cutting tools. This embodiment is characterized by a prismatical slide with an usually right-angled cross-section. The slide core is guided with a cast housing absolutely free from backlash and maintenance-free (for lifetime) due to a special heavy-load slideway technique. The slide shows a pocket into which a special hydraulic cylinder is inserted laterally to the movement axis. This hydraulic cylinder shows a piston with two continuous piston rods or with a piston rod and a driving slot which act onto the front sides of the pocket in the slide and thus transfer the forces of pressure onto the slide for a forward and a back motion. The hydraulic special cylinder is provided on one longitudinal side with a mounting flange by means of which it is screwed on the slide housing. For this purpose, the slide housing has an opening on its upper longitudinal side. The hydraulic oil connections are also on this mounting flange. There is a lateral connection as well as a connection orientated upwards with a corresponding guiding of the pipes in order to be adapted to different confined mounting conditions. The described linear path slide is characterized by its heavy-load capacity and the precise slideway of the prismatical slide. However, its useability is limited in some cases by its size and weight. Moreover, a repair of the linear path slide is relatively complicated.

SUMMARY OF THE INVENTION

The aim of the invention is to obtain, for a linear path slide of the above mentioned type, a compacter construction with a reduced volume and a reduced weight. Simultaneously, the linear path slide should be easier to repair and should be flexibler in its useability. Not least the manufacturing costs should also be reduced.

Accordingly, the linear path slide contains in a known way a slide which is arranged slidingly movable in a housing with a sliding guide as well as a hydraulic driving gear which causes the displacing of the slide and which has a piston arranged slidingly movable in a cylinder by constituting a hydraulic working space. Accordingly, this linear path slide is characterized in that the cylinder and the working space are configured in the slide and the piston is fixed with respect to the housing.

Here, by "cylinder", we do not necessarily understand a cylinder in the mathematical sense, i.e. with a circular cross-section, but any working space limited by parallel walls in which a piston, the cross-section of which corresponds to the cross-section of the working space, can move parallel to the walls. Besides a mathematical cylindrical shape, the "cylinder" can also show in particular a cross-section in form of a regular polygon.

In the linear path slide according to the invention, the functions of the slide and of the hydraulic driving gear are combined in a structural component. This is possible since the hydraulic driving gear is integrated into the slide itself. Many advantages result from this measure. So, the giving up of two separated structural components (slide, hydraulic driving gear) allows a compacter thinner construction by saving construction volume. Components are additionally saved (for example housing with cylinder bore hole and mounting flange) and thus a high saving of costs and weight is achieved. The falling away of junctures in which for example the mechanical pressure force introduction takes place from the hydraulic driving gear to the slide, causes a further reduction of the production costs and avoids potential sources of errors.

Furthermore, for the linear path slide according to the invention, the arrangement of the slide and of the hydraulic driving gear can ensue with a high symmetry, the cylinder and the piston being placed on the center axle/axle of movement of the slide. Thus, there results a central and symmetrical force introduction which avoids the occuring of tilting moments. This causes a lower parasitic stress and increases the reliability and the longevity of the structural component. For linear path slides with a traditional construction, a corresponding symmetrical configuration would have resulted in considerably bigger structural shapes with an inacceptable specific power capacity.

Advantageous configurations of the invention are characterized in the subclaims.

The slide is constructed preferably as a prismatic slide. Thus, a high precision and a high stiffness are obtained in an experienced way.

Furthermore, it is preferred that the sliding guide, which is placed between the slide and the housing, is produced by a casting process. Such a casting process results on the one hand in a very high quality sliding guide and is simultaneously very advantageous as to the costs.

In an advantageous further development of the invention, the piston separates the cylinder into two separate working spaces, a volume increasing of the working spaces resulting in an opposite movement of the slide. In this way, it is possible through the inflow of hydraulic media and a pressure feeding into the corresponding working space to cause an active forward movement of the slide as well as an active back movement thereof. Since the piston divides the existing cylinder space into two parts, an optimal using of this space is simultaneously obtained.

For a possible realization of this alternative of the invention, the piston is placed at the end of a piston rod which has a smaller diameter than the piston and which is guided outwards on one side of the cylinder (i.e. of the slide). Here, the duct of the piston rod is tightly sealed all around so that no hydraulic media can flow out. In this arrangement, the piston separates the cylinder space into two working spaces which can be designated as lying on this side and on the other side of the piston rod. An introduction of pressure into the respective working spaces affects different sides of the piston and thus results in corresponding opposite forces onto the slide.

For fulfilling their function, the hydraulic working spaces must be provided with a feeding pipe for hydraulic media (for example oil). This feeding pipe is preferably placed in the piston and in the piston rod connected with the piston. Such an arrangement utilizes the fact that, on the one hand, the piston of the linear path slide according to the invention is fixed and, on the other hand, that it constitutes a part of the delimiting walls of the working space. Thus, the feeding pipe of the hydraulic media can be guided without problem from an outer connection through the piston rod and the piston to the place of use (and back). This is naturally also the case when, as in an above described embodiment of the invention, two working spaces are configured within the slide.

In the last mentioned case in which two different working spaces are fed with feeding pipes through the piston, these feeding pipes are preferably placed parallel or concentrically in the piston. Since the parallel arrangement allows a simpler fabrication due to deep bore holes with less structural components, the concentrical arrangement is especially chosen when the linear path slide should be configured very compact.

In a further development of the invention, the slide has a rear and/or a front limit stop sensor. This sensor allows to ascertain and to supervise if the slide is at one of the limit stops. This information is generally important for the higher processing step so that the precise detection of this state can advantageously be used for controlling the whole process.

The piston is detachably connected with the housing, whereby especially a screw-type and/or bayonet-type fixing is possible as a connection. A maintenance and repair of the linear path slide is possible by loosening the piston from the housing. Here, only one component has to be loosened in order to simultaneously obtain the access to the hydraulic space and to the slide. The maintenance of the linear path slide is thus considerably simplified which becomes apparent in the lower operating costs and in a longer lifetime.

In a further development of the invention, it is provided that the hydraulic cylinder is no longer directly formed by the inner wall of the stemple but by a separate cylinder case. This case is placed in a corresponding opening in the stemple. Such an arrangement has the advantage that the hydraulic unit is entirely placed in the cylinder bush and can also thus be entirely disassembled from the rear side of the linear slide without the slide itself having to be removed. Tools mounted on the slide such as, for example, precisely aligned cutters or the like have not to be removed. Thus, the risk of a deterioration of the inner wall or of the sliding guide by the tools is excluded. Moreover, the hydraulic oil is encapsulated by the cylinder bush and thus cannot soil the mounting place. Finally, the widening of the stemple is also avoided, since the hydraulic pressure does not act directly onto the stemple but onto the cylinder bush. This is extremely advantageous considering the anyway narrow tolerances of the slide gap.

BRIEF DESCRIPTION OF THE DRAWINGS

Embodiments of the invention will be described below with reference to the attached drawings.

DETAILED DESCRIPTION OF THE PREFERRED EMBODIMENT

Figure 1:
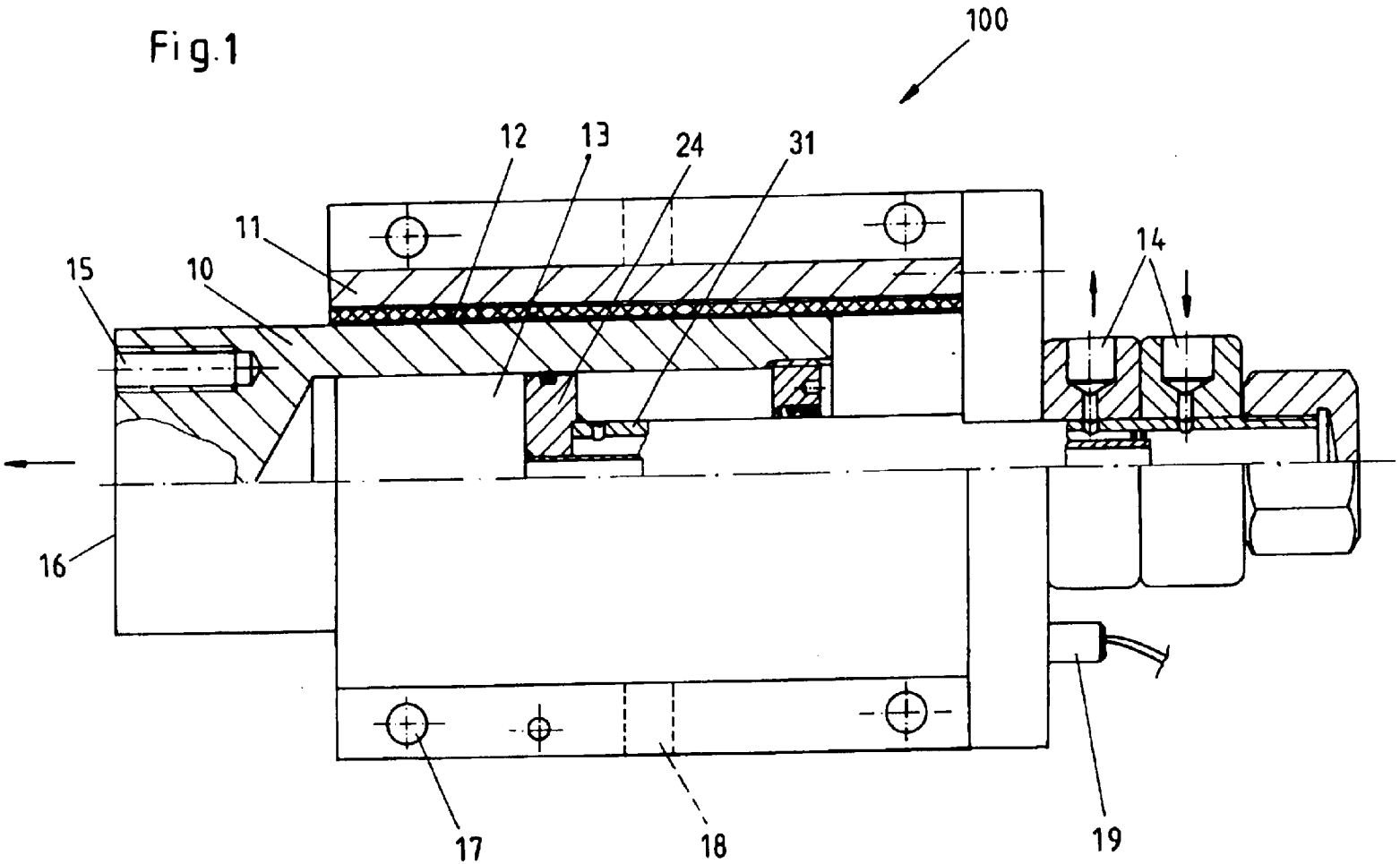
FIG. 1 shows a top view of the linear path slide during a working stroke.

In FIG. 1, a top view of a linear path slide 100 according to the invention is represented, the housing 11, the slide 10, the piston and the piston rod being represented partially opened in the upper half of the picture in order to make the inner structure recognizable. The linear path slide 100 has a compact and substantially cuboid structural shape. It consists of a housing 11 which has at, its lower end, a bottom flange with bore holes 17 for fastening screws and dowel pins for fixing the linear path slide to a machine (see also FIG. 3). Furthermore, a groove 18 is placed on the lower side of the housing 11 for receiving a feather key on the mounting surface.

The slide 10 is placed slidingly movable in the housing 11 in direction of the longitudinal axis of the housing (horizontal level in FIG. 1). The slide is preferably constructed with a square core. The slide 10 has a mounting surface 16 accessible from outside in which one or several threaded holes 15 are sunk-in for the mounting screws. In this way, different elements can be connected with the slide 10 depending on the purpose of application. The slide 10 is placed slidingly movable in direction of its longitudinal axis and can be moved out of the housing 11 by the length of its working stroke. Usual stroke paths lie between 30 and 100 mm, for special designs also up to 500 mm. The forces, which the slide 10 has to exert in axial direction (longitudinal forces) are in the range of 10 kN (1 to) to 100 kN (10 to), in particular cases also up to 250 kN (25 to). Due to an eccentric stress of the slide during the working process, the transverse loads onto the slide even can be a multiple of the nominal force of pressure. However, no warping or torsion of the slide may occur here. These requirements are very high especially for cutting tools for which a stiffness must be guaranteed in the extended (working) position with said existing transverse loads for which the lateral excursion is less than 0,02 mm.

For meeting these heavy-load precision requirements, not least there is a special sliding guide 12 which is placed in the gap between the slide 10 and the housing 11. This sliding guide is preferably produced by a casting process.

The particularity according to the invention of the linear path slide represented in FIG. 1 consists in that the hydraulic driving gear is integrated into the slide 10. A blind hole is on the rear side of the slide 10, i.e. on the surface opposite the mounting surface 16. The slide 10 constitutes with the blind hole the cylinder of a hydraulic driving gear, a piston 24 with a piston rod 31 being placed in the blind hole and delimiting the hydraulic working space 13 together with the blind hole.

Feeding pipes 14 for the hydraulic oil as well as a limit stop sensor 19 are placed on the rear side of the linear path slide 100. These elements will be explained in more detail with reference to FIG. 2.

Figure 2:
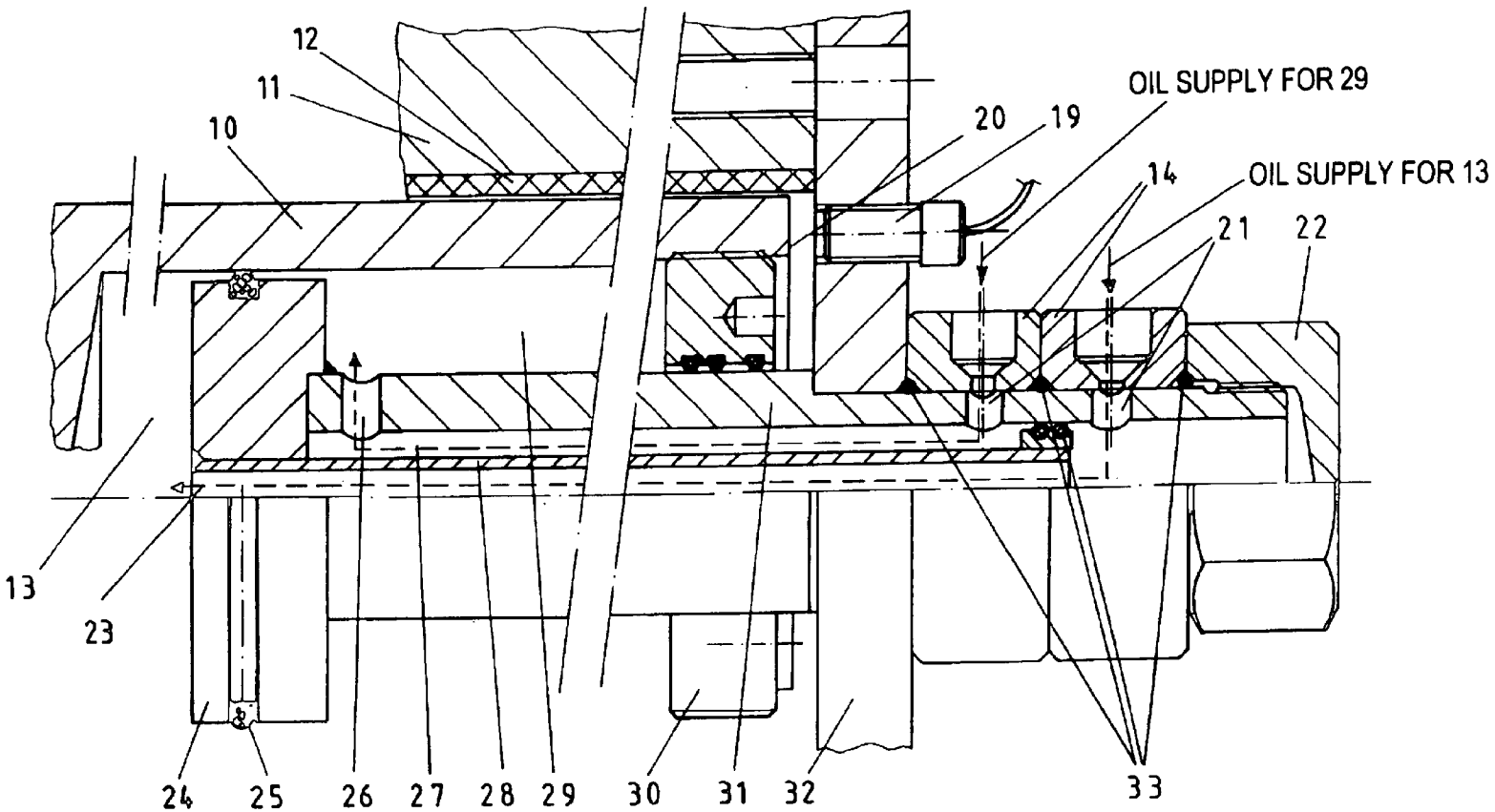
FIG. 2 shows a detail of the top view of the linear path slide.

FIG. 2 shows an enlarged view of the structure of the hydraulic driving gear integrated into the slide 10. In the representation, the housing 11 has been uncovered and a section has been made in the upper part of the figure along the center axle. Substantially the portion of the slide 10 with the blind hole is represented. The piston 24 is movably placed (along the horizontal longitudinal axis in FIG. 2) in the blind hole. The piston 24 has a continuous groove 25 on its outer periphery, groove in which there are a piston packing and guiding bands. Thus, a tight hydraulic working space 13 is constituted between the piston 24 and the slide 10.

The piston 24 is placed fixed at the end of a piston rod 31. The piston rod 31 is itself fixed connected with the housing 11 and projects at the rear end over the rear wall of the housing 11, the so-called piston rod lock 32. Two oil connecting flanges 14 are placed on this protruding end of the piston rod 31 and are locked with a tension loaded tensioning nut 22. Moreover, the piston rod 31 has a central bore hole 27 along its longitudinal axis. This bore hole 27 is closed at the rear end (on the right in FIG. 2) by the tensioning nut 22. Furthermore, two radial bore holes 21 are placed on the rear end of the piston rod 31 which projects from the housing 11, bore holes which come to rest under the oil connecting flanges 14 and serve for the passing of hydraulic oil into the central bore hole 27.

At the other end of the piston rod 31 to which the piston 24 is fixed (on the left in FIG. 2), the central bore hole 27 with the smaller cross-section is continued through the piston and thus constitutes the oil outlet 23 into the working space 13. Furthermore, a pipe 28 is placed as a central oil duct parallel to the center axle of the piston rod 31. This pipe leads at its front end sealed into the oil outlet 23 in the piston 24 and is sealed at its rear end (on the right in FIG. 2) with a sealing 33 relatively to the wall of the central bore hole 27. Thus, a feeding pipe for hydraulic oil which is tight all around is created which begins at the one rear oil connecting flange 14 and through the rear oil feeding bore hole 21 and the inside of the pipe 28 to the working space 13. A pressure is generated in the hydraulic working space 13 by the passing of hydraulic oil along this path. The device reacts to this pressure with a translating of the slide 10 in the extension direction (on the left in FIG. 2, compare arrow in FIG. 1).

Thus, an extension of the slide 10 can be hydraulically effected with the above described device. On the other hand, a running back of the slide 10 should take place either passively or should be caused by a depression in the working space 13. On the other hand, for improving the force development and the controllability of the running back of the slide 10, a second hydraulic working space 29 is provided for in this embodiment. This second working space 29 is constituted between the rear side of the piston 24, the outside of the piston rod 31, the inner wall of the blind hole in the slide 10 and the front side of a piston rod sealing nut 30 (provided with sealing scraper and guiding bands). This working space 29 has thus the shape of an annular gap around the piston rod 31.

The piston rod sealing nut 30 is fixedly connected with the slide 10 and placed at its rear end at the entrance of the blind hole. It thus closes the blind hole up to a central opening through which the piston rod 31 is guided. The sealing nut 30 is not placed even with the end of the slide but on the contrary the slide has a projection 20 over the sealing nut. Thus, the projection 20 constitutes a limit stop for the completely withdrawn slide. The sealing nut 30 sits slidingly movable around the piston rod 31 and is sealed with packings against the piston rod. From the front one of the two oil connecting flanges 14, the front one of the two radial bore holes 21 leads into an annular gap which is constituted between the outer wall of the pipe 28 and the inner wall of the blind hole bore hole 27. This annular gap leads at its front end over a radial bore hole 26 through the piston rod 31 into the working space 29. Thus, hydraulic oil can be fed to the working space 29 on this way. An introduction of hydraulic oil causes then an increase of pressure in the working space 29 which is translated as a return force onto the slide 10 over the sealing nut 30. The slide 10 can thus be actively run-in.

The housing 11 is closed on its rear side by the piston rod lock 32. The piston rod lock is fixedly screwed with the housing 11. Furthermore, it has a central breaking-through through which the piston rod 31 is guided. The piston rod lock 32 thus separates the inner side of the linear path slide from the outside. Moreover, two bore holes preferably offset by 90° are made in the piston rod lock 32, the sensor 19 for the limit stop of the slide 10 being placed in one of the bore holes and the second bore hole serving to the aeration of the rear slide free space. The use of bore holes for the end position sensor or as aeration opening can alternatively ensue depending on the constructional conditions due to the surroundings. The projecting end of the sensor 19 and the cable connection or the plug connection are for the selected arrangement at a protected place and are thus protected from damages. If the bore hole remains free as an aeration opening, it can be closed with a sieve stopper. Additionally, it can also be provided with an adsorbing element in order to collect even a small quantity of leaking oil. In this way, a complete contamination freedom (for product parts) by hydraulic leaking oil can be guaranteed.

Besides the rear end position sensor 19, a switch rod with an adjustable switch cam can be additionally mounted on the slide 10 for the recognition of the front end position, this switch rod being guided to the rear side by a further bore hole in the piston rod lock 32 and the switch cam of which being scanned by a further initiator.

Both oil connections 14 are designed as free rotatable flanges and can thus be swivelled for the mounting in any direction. Both flanges are preferably of the same construction. They can be provided with additional throttle screws for the control of the rate of flow.

The pressure oil feeding to the working spaces 13 and 29 preferably takes place in the represented manner through a central continuous bore hole 27 in the piston rod 31 in which a central pipe 28 with sealing is additionally introduced in order to feed the main working space 13 in the piston bottom. For appropriate bigger piston rod diameters, two separate deep hole bore holes can however be provided instead of the concentrical oil feeding. Furthermore, by selecting appropriate piston rod diameters, a special quick motion behaviour for the return stroke can be constructionally provided for.

The slide housing 11 has no (lateral) breaking-through or openings so that its stiffness is increased and the production costs are reduced. The additional stiffness reserves can also be used for reducing the weight of the device. Furthermore, the missing of breaking-through openings facilitates the placing-in by casting of the sliding bearing layer 12 and the processing thereof. The simple structure of the housing allows its manufacturing as a continuous casting profile or as a continuous extruded profile. The same tools for the unmachined parts can be used for different stroke lengths. The making available of special lengths is also possible by simply shortening the housing and the slide of the next bigger version.

Figure 4:
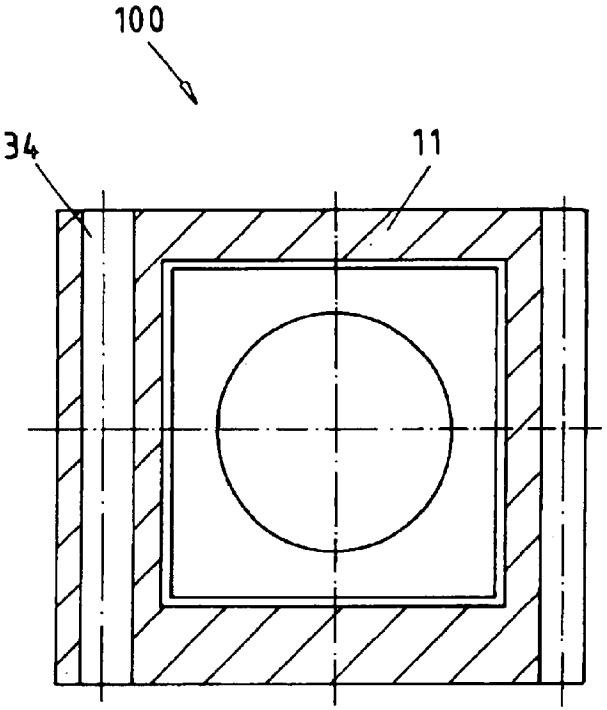
FIG. 4 shows a back view of a linear path slide with through fastening screws.
Figure 3:
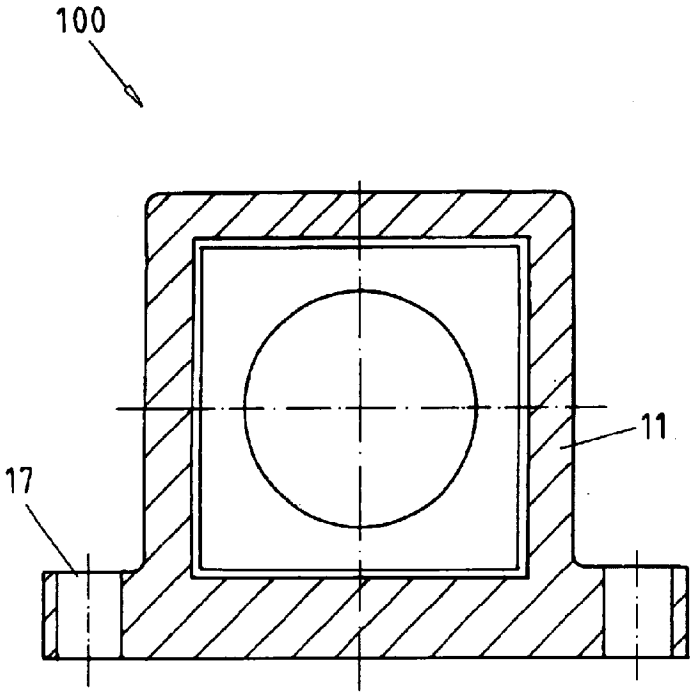
FIG. 3 shows a back view of a linear path slide with a bottom flange.
Figure 5:
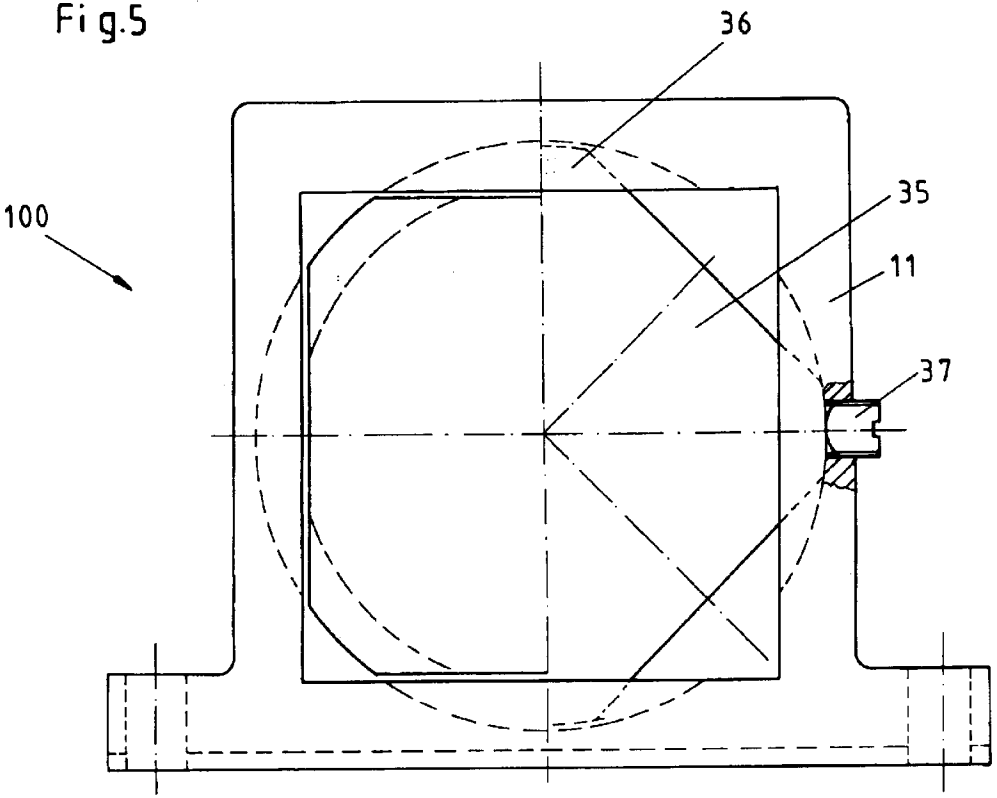
FIG. 5 shows a back view of a linear path slide with a plug/turn cylinder rod locking.

Rear views of alternatives of the linear path slide are represented in FIGS. 3 to 5.

FIG. 3 shows a version for which the housing 11 has a bottom flange which is provided with bore holes 17 for fastening screws and dowel pins. Alternatively or additionally to the represented bottom flange placed on the longitudinal side of the housing 11, the housing can also be provided with a front flange which is preferably placed on the outlet side of the slide, FIG. 4 shows an alternative housing 11 without bottom flange which has continuous bore holes 34 for through fastening screws in the side walls.

A type of fixing the piston rod lock 35 which is an alternative to the screwing is represented in FIG. 5. The housing 11 has a square opening on its rear side which widens to a cylinder to the inside, the diameter of the cylinder lying between the side length and the diagonal of the square. The piston rod lock 35 has a square basic shape (with rounded corners) which is adapted to the rear side of the housing 11 just because of the square opening. The piston rod lock 35 can thus be inserted through the square opening into the inside of the housing 11. As soon as it reaches the area of the cylindrical widening, it twists about 45° so that its corners 36 lie in the art of a bayonet-type locking behind the side middles of the rear square opening in the housing 11 which project over the cylinder wall. In this position, the piston rod lock 35 cannot thus move out of the housing 11. It is locked in this position by means of a locking screw 37 which is guided through the wall of the housing 11 to a corner of the piston rod lock 35. This arrangement has the advantage that the device can be dismantled by loosening a single screw 37 and twisting the piston rod lock 35 about 45°.

The complete movable unit can be removed "to the back" after having released the piston rod lock 35 (or 32). The plug/turn connection described with reference to FIG. 5 can also be designed as a multiple indenting.

Figure 6:
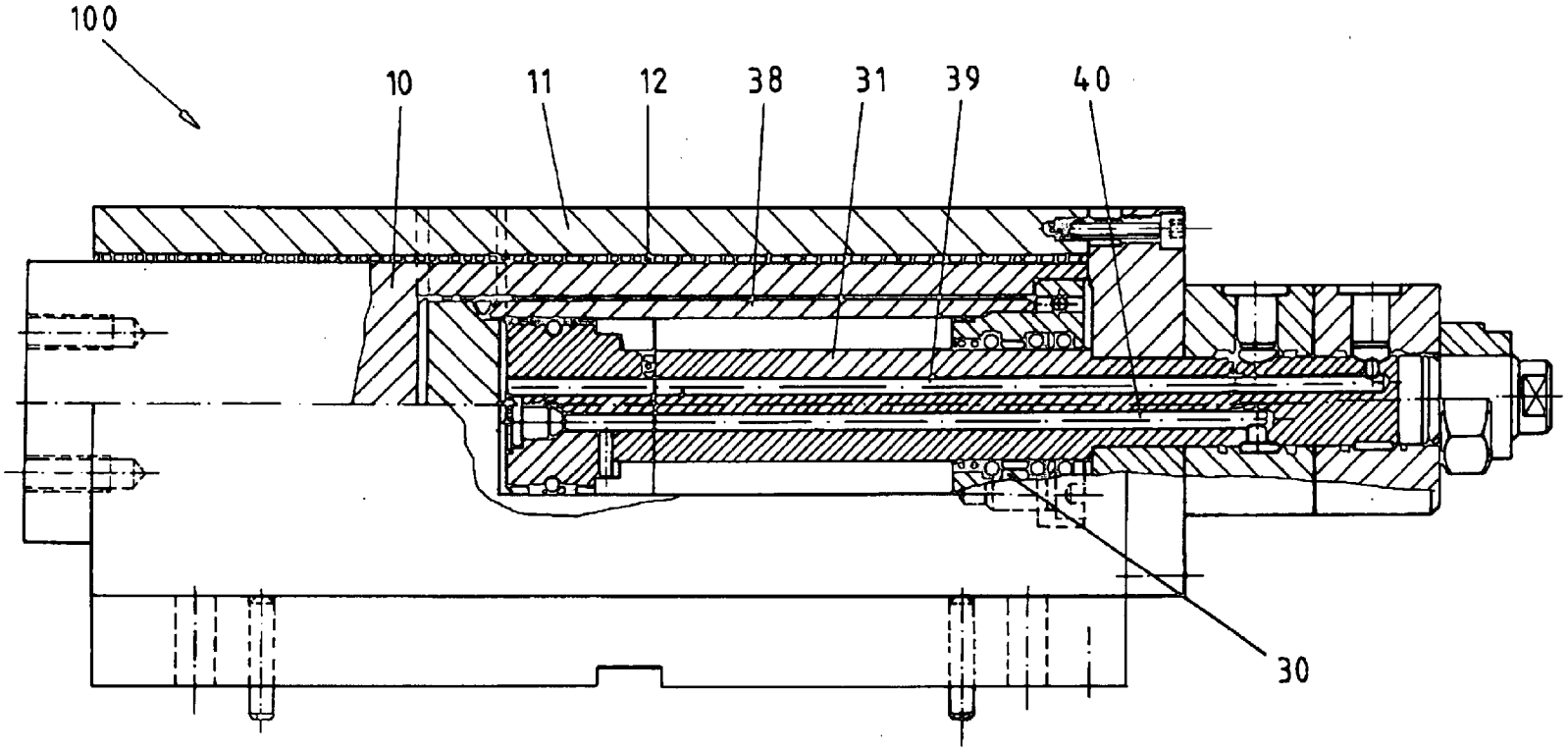
FIG. 6 shows an alternative configuration of a linear slide with a cylinder bush which is placed in a blind hole of the stemple.

In FIG. 6, an alternative configuration of the linear path slide 100 is represented in a partially opened top view similar to FIG. 1. The elements with the same construction as in the preceding configurations are designated with the same reference numerals and do not need to be explained again.

The decisive change in this configuration consists in that the hydraulic cylinder is no longer formed directly by the inner wall of the blind bore hole of the stemple but by a separate cylinder bush 38. This cylinder bush is placed in the blind hole and fixed to the stemple 10 for example by a screwed connection. The cylinder bush 38 is closed at its entrance opening by a sealing nut 30 so that both hydraulic working spaces are entirely formed in the cylinder bush 38.

Such an arrangement has the advantage that the hydraulic unit is entirely positioned in the cylinder bush 38 and thus can be completely dismantled from the rear side of the linear path slide 100 without the slide itself having to be removed. Tools mounted on the slide such as, for example precisely aligned cutters or the like, must not be removed. Thus, the risk of a deterioration of the sliding guide 12 due to the removal is excluded. Moreover, the hydraulic oil is encapsulated by the cylinder bush 38 and thus cannot soil the mounting place. Finally, the widening of the stemple is also avoided, since the hydraulic pressure does not act directly onto the stemple but onto the cylinder bush. This is extremely advantageous considering the anyway narrow tolerances of the slide gap.

Furthermore, in the embodiment according to FIG. 6, the alternative is realized in that the hydraulic oil is guided over two parallel conduits 39 and 40 in the piston rod 31 to the rear or to the front working space.

Reference Numerals

10 Slide
11 Housing
12 Sliding guide
13 Working space
14 Oil connecting flange
15 Threaded bore hole
16 Mounting surface
17 Bore hole
18 Groove
19 End position sensor
20 Projecting part
21 Radial bore hole
22 Tensioning nut
23 Oil outlet
24 Piston
25 Groove
26 Oil outlet
27 Central bore hole
28 Pipe
29 Working space
30 Sealing nut

31 Piston rod
32 Piston rod lock
33 Sealings
34 Through bore hole
35 Piston rod lock
36 Corner
37 Fastening screw
38 Cylinder bush
39 Hydraulic channel to the working space 13
40 Hydraulic channel to the working space 29
100 Linear path slide

What is claimed is:

1. A linear path slide (100) comprising:

a slide (10) which is arranged with a sliding guide (12) slidingly movable and resistant to torsion in a housing (11), a hydraulic driving gear which causes the translation movement of the slide (10) and which has a piston (24) with a piston rod (31) arranged slidingly movable in a cylinder, wherein the piston (24) divides the cylinder into a first working chamber (13) remote from the piston rod (31) and a second working chamber (29) surrounding the piston rod (31), wherein the cylinder and the working chambers (13, 29) are placed in the slide (10) and the piston (24) is fixed with respect to the housing (11), wherein a volume increase of the first and second working chambers (13, 29) causes a movement of the slide (10) in opposite directions, respectively, wherein the piston (24) and the piston rod (31) have a central bore hole (27) and a pipe (23) arranged in the central bore hole (27) so that between an outer wall of the pipe (28) and an inner wall of the central bore hole (27) a passage is formed for feeding hydraulic fluid into the second working chamber (29), wherein the central bore hole (27) and the pipe (23) are parallel or concentric to one another, wherein the pipe (28) feeds the hydraulic fluid into the first working chamber (13), wherein the slide (10) has at least one of a front limit stop sensor and a rear limit stop sensor (19), and wherein the housing (11) has a square opening at a rear side thereof, wherein the square opening widens to a cylinder toward the inside of the housing (11), wherein the cylinder has a diameter between a length of a side of the square opening and a diagonal of the square opening.

2. A linear path slide according to claim 1, wherein it contains a prismatical slide (10).

3. A linear path slide according to claim 1, wherein the sliding guide (12) has been produced in a casting process.

4. A linear path slide according to claim 1, wherein the piston (24) is detachably connected with the housing (11).

5. A linear path slide according to claim 1, wherein the cylinder is formed by a cylinder bush (38) which is placed in an opening of the slide.

6. A linear path slide according to claim 4, wherein the piston (24) is connected by a screw connection or a bayonet lock to the housing (11).

* * * * *